US009180332B1

(12) United States Patent
Tenorio et al.

(10) Patent No.: US 9,180,332 B1
(45) Date of Patent: Nov. 10, 2015

(54) COMPRESSIVE EXERCISE DEVICE

(71) Applicants: Juan M. Tenorio, Miami, FL (US); Luis Tenorio, Miami, FL (US)

(72) Inventors: Juan M. Tenorio, Miami, FL (US); Luis Tenorio, Miami, FL (US)

( * ) Notice: Subject to any disclaimer, the term of this patent is extended or adjusted under 35 U.S.C. 154(b) by 190 days.

(21) Appl. No.: 14/068,255

(22) Filed: Oct. 31, 2013

(51) Int. Cl.
*A63B 21/02* (2006.01)
*A63B 21/05* (2006.01)
*A63B 21/055* (2006.01)

(52) U.S. Cl.
CPC ..... *A63B 21/0557* (2013.01)

(58) Field of Classification Search
CPC .... A63B 21/00; A63B 21/05; A63B 21/0552; A63B 21/0555; A63B 21/0557; A63B 21/00058; A63B 21/00069
USPC ..... 482/92, 121–123, 125, 126, 128, 129
See application file for complete search history.

(56) References Cited

U.S. PATENT DOCUMENTS

| | | | | | |
|---|---|---|---|---|---|
| 3,589,720 | A * | 6/1971 | Agamian | ..... | 482/114 |
| 3,620,530 | A * | 11/1971 | Cosby | ..... | 482/130 |
| 4,148,479 | A | 4/1979 | Spector | | |
| 4,351,527 | A | 9/1982 | Crisp, Jr. | | |
| 4,373,716 | A | 2/1983 | Pagani | | |
| 4,376,533 | A * | 3/1983 | Kolbel | ..... | 482/125 |
| 4,865,317 | A * | 9/1989 | Hickey | ..... | 482/126 |
| 5,071,119 | A * | 12/1991 | Johnson | ..... | 482/112 |
| 5,154,685 | A * | 10/1992 | Chen | ..... | 482/126 |
| 5,178,599 | A | 1/1993 | Scott | | |
| 5,232,425 | A * | 8/1993 | Miller et al. | ..... | 482/121 |
| 5,250,015 | A | 10/1993 | Thornton | | |
| 5,411,460 | A | 5/1995 | Karlson et al. | | |
| 5,700,232 | A * | 12/1997 | Clausen et al. | ..... | 482/125 |
| 5,749,815 | A * | 5/1998 | Lipps | ..... | 482/122 |
| 6,022,301 | A | 2/2000 | Fahlman | | |
| 6,071,217 | A * | 6/2000 | Barnett | ..... | 482/121 |
| 6,206,811 | B1 * | 3/2001 | Lat | ..... | 482/126 |
| 6,976,942 | B2 * | 12/2005 | Kennedy | ..... | 482/122 |
| 7,288,052 | B1 * | 10/2007 | Guillaume | ..... | 482/142 |
| D619,181 | S | 7/2010 | Oller | | |
| 8,608,630 | B2 * | 12/2013 | Wu | ..... | 482/126 |
| 2005/0101457 | A1 * | 5/2005 | Tuller | ..... | 482/128 |

* cited by examiner

*Primary Examiner* — Stephen Crow
*Assistant Examiner* — Garrett Atkinson

(57) ABSTRACT

A compressive exercise device facilitates exercises utilizing compressive force to develop multiple parts of the body. The device includes an elongated tube. A top section of the tube is slidably inserted into a bottom section wherein the tube is telescopic. A longitudinal slot extends through the bottom section of the tube. A resilient loop has a first end coupled to the bottom section of the tube proximate a bottom end of the bottom section. Each of a pair of rollers is coupled to an associated side of the bottom section between the top end of the slot and a top end of the bottom section. The loop extends over each roller. A pin coupled to the top section extends through the slot and slides in the slot when the tube is compressed. The loop is coupled to the pin such that the loop resists compression of the tube.

15 Claims, 5 Drawing Sheets

COMPRESSIVE EXERCISE DEVICE

BACKGROUND OF THE DISCLOSURE

Field of the Disclosure

The disclosure relates to exercise devices and more particularly pertains to a new exercise device for facilitating a plurality of exercises utilizing compressive force to exercise and develop multiple parts of the body.

SUMMARY OF THE DISCLOSURE

An embodiment of the disclosure meets the needs presented above by generally comprising an elongated tube. A top section of the tube is slidably inserted into a bottom section wherein the tube is telescopic. A longitudinal slot extends through the bottom section of the tube. A resilient loop has a first end coupled to the bottom section of the tube proximate a bottom end of the bottom section. Each of a pair of rollers is coupled to an associated side of the bottom section between the top end of the slot and a top end of the bottom section. The loop extends over each roller. A pin coupled to the top section extends through the slot and slides in the slot when the tube is compressed. The loop is coupled to the pin such that the loop resists compression of the tube.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
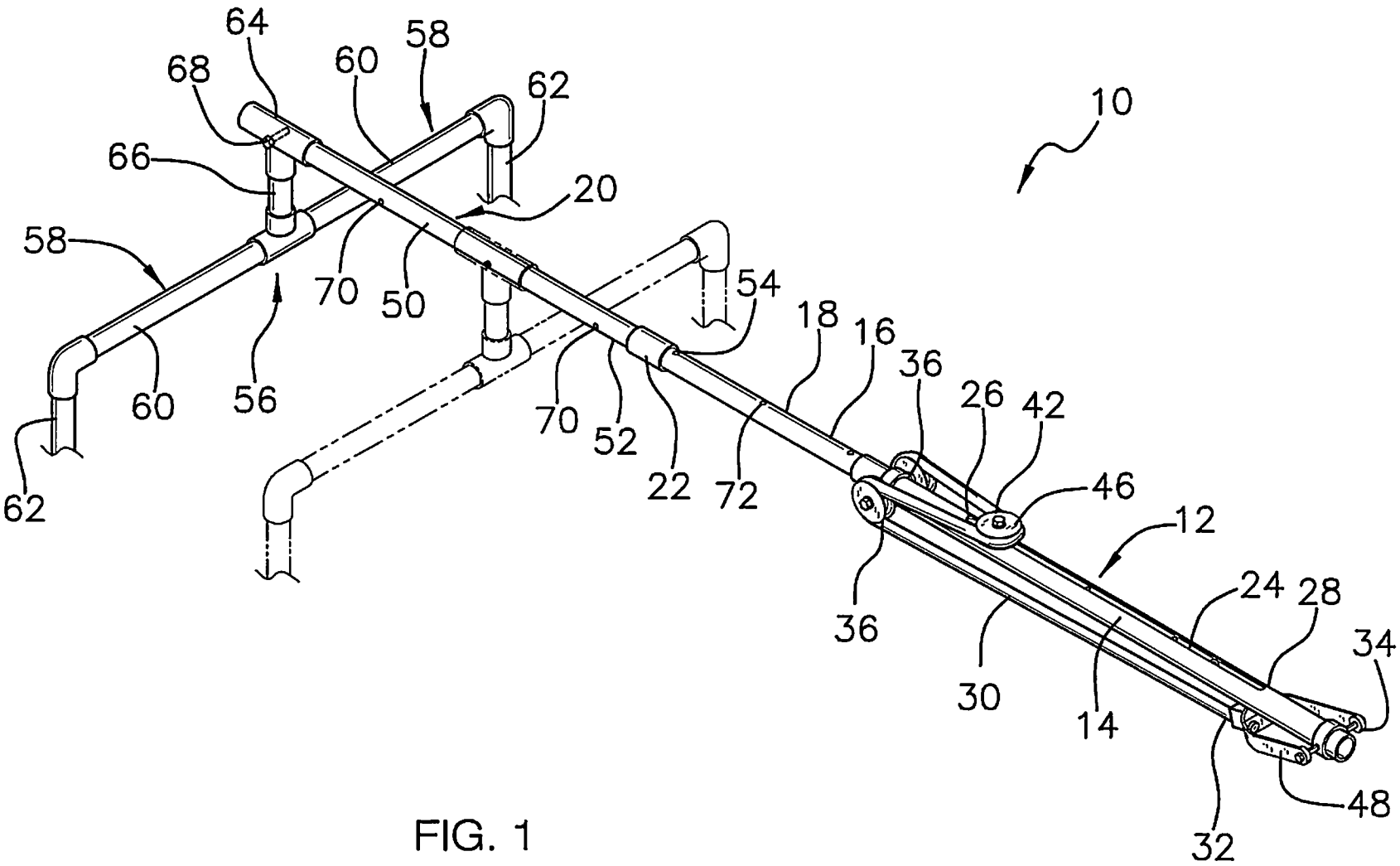
FIG. 1 is a bottom front side perspective view of a compressive exercise device according to an embodiment of the disclosure.
Figure 2:
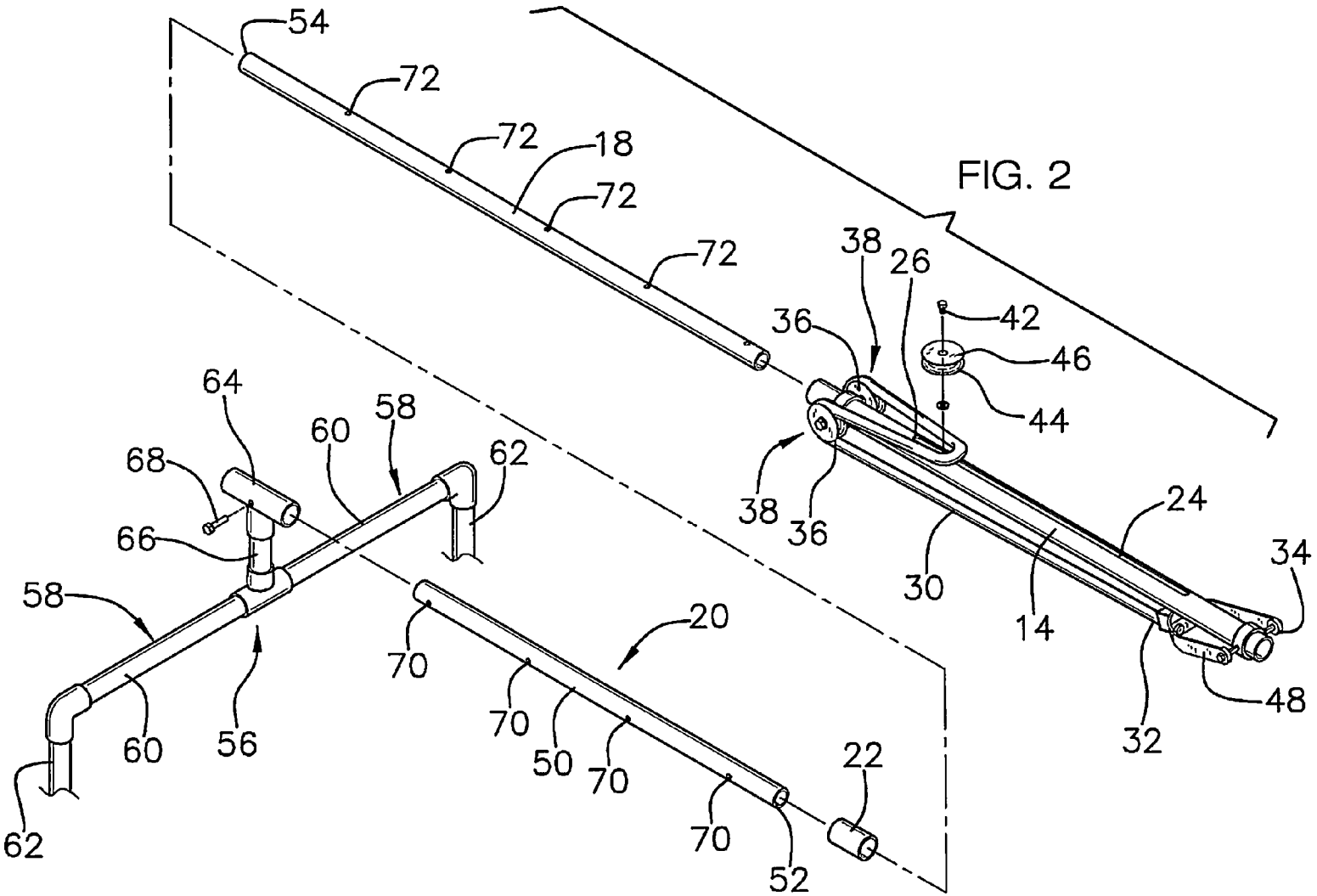
FIG. 2 is a partially exploded bottom front side perspective view of an embodiment of the disclosure.
Figure 3:
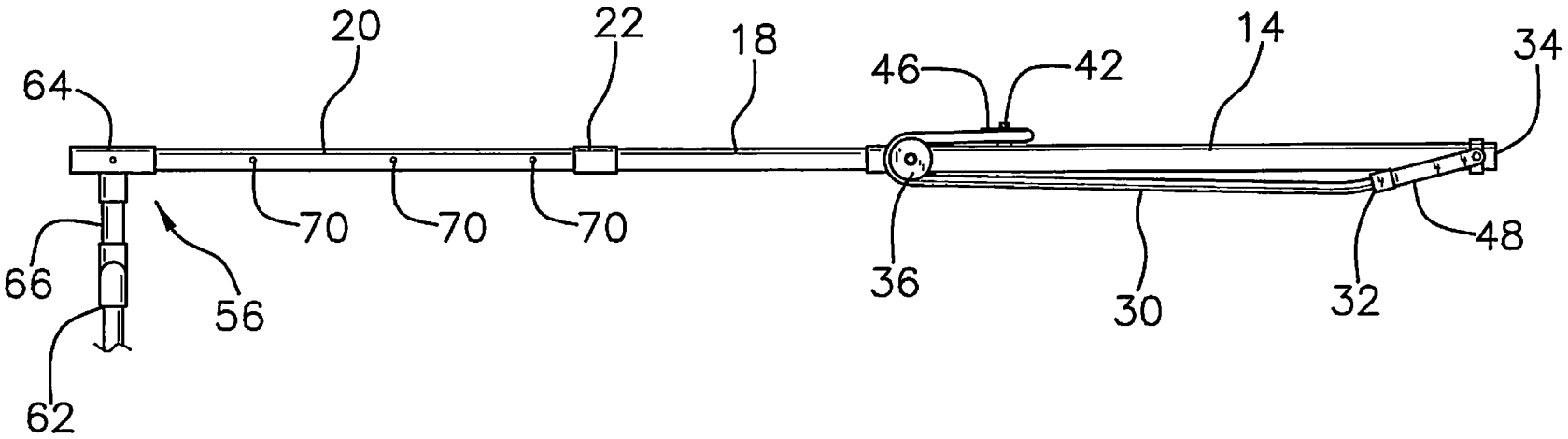
FIG. 3 is a side view of an embodiment of the disclosure.
Figure 4:
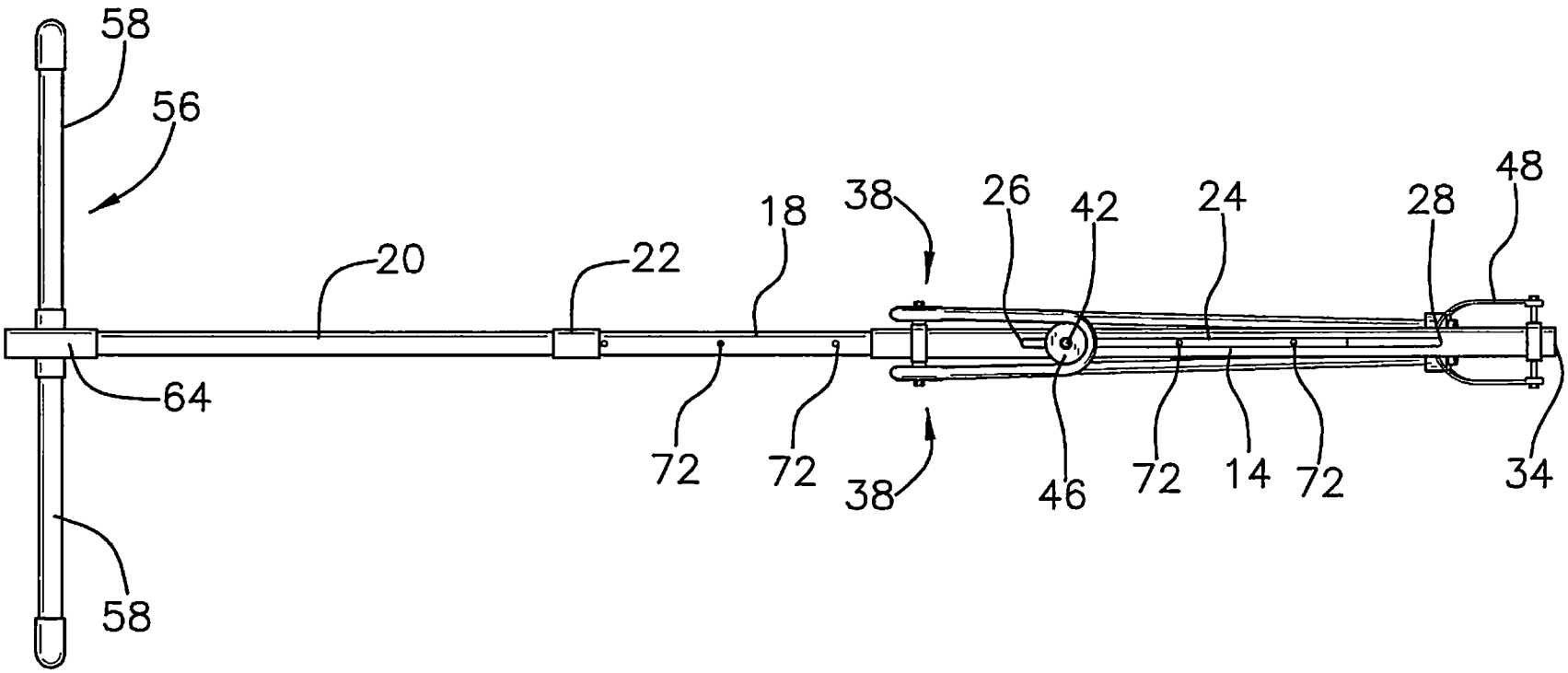
FIG. 4 is a front view of an embodiment of the disclosure.
Figure 5:
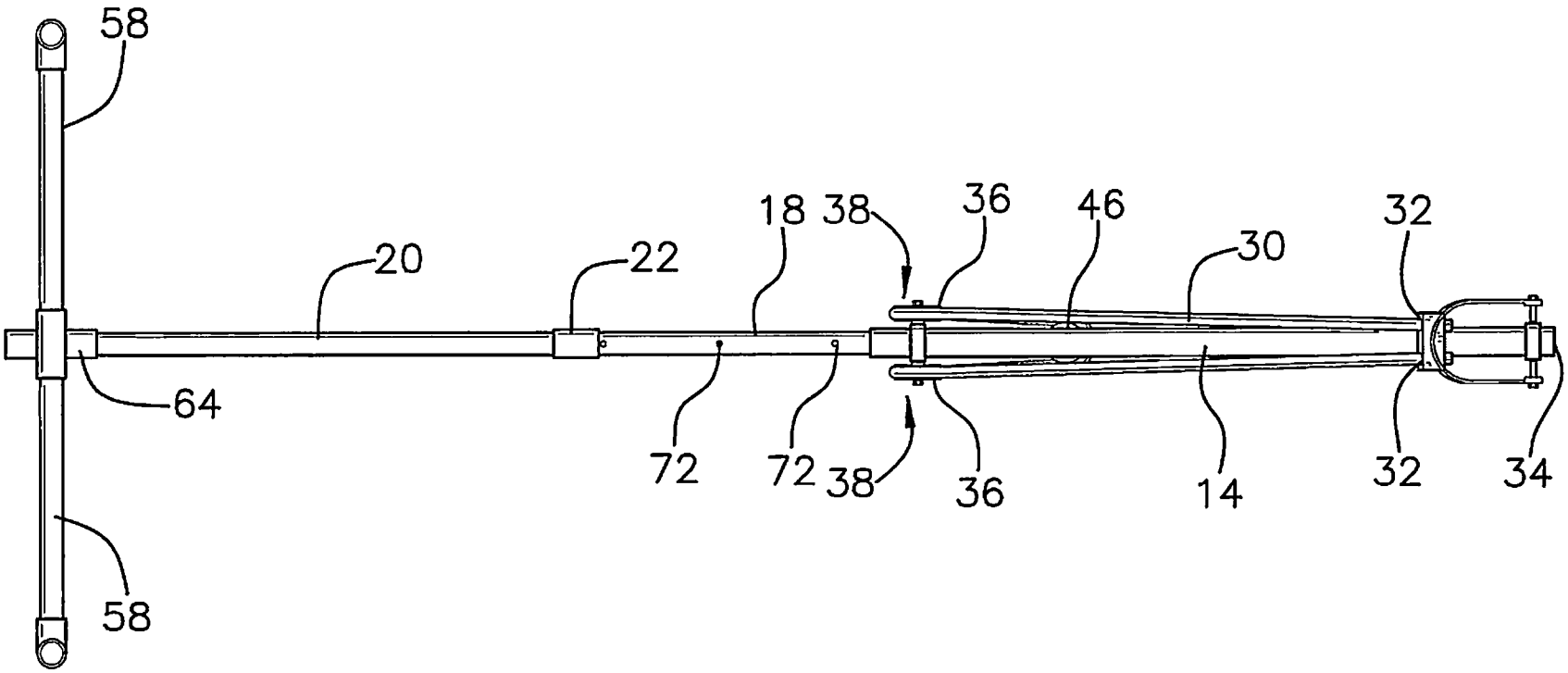
FIG. 5 is a back view of an embodiment of the disclosure.

With reference now to the drawings, and in particular to FIGS. 1 through 5 thereof, a new exercise device embodying the principles and concepts of an embodiment of the disclosure and generally designated by the reference numeral 10 will be described.

As best illustrated in FIGS. 1 through 5, the compressive exercise device 10 generally comprises a tube 12 being elongated and having a bottom section 14 and a top section 16. The top section 16 is slidably inserted into the bottom section 14 wherein the tube 12 is telescopic. The top section 16 of the tube 12 may comprise a first portion 18 coupled to a second portion 20. A connector 22 couples the first portion 18 to the second portion 20 such that the first portion 18 is linearly aligned with the second portion 20. A longitudinal slot 24 extends through the bottom section 14 of the tube 12. The slot 24 has a top end 26 and a bottom end 28. A loop 30 is resilient and has a first end 32 coupled to the bottom section 14 of the tube 12 proximate a bottom end 34 of the bottom section 14 of the tube 12.

Each of a pair of rollers 36 is coupled to an associated side 38 of the bottom section 14 of the tube 12 between the top end 26 of the slot 24 and a top end 40 of the bottom section 14 of the tube 12. The loop 30 extends over each of the rollers 36. A pin 42 is coupled to the top section 16 of the tube 12. The pin 42 extends through the slot 24 and is slidable in the slot 24 as the top section 16 of the tube 12 slides relative to the bottom section 14 of the tube 12. The loop 30 is coupled to the pin 42 such that the loop 30 is stretched as the pin 42 is moved in the slot 24 away from the top end 26 of the slot 24 towards the bottom end 28 of the slot 24 wherein the loop 30 provides resistance to compression of the tube 12.

A channel 44 is coupled to the pin 42. The loop 30 is seated in the channel 44. A wheel 46 is rotatably coupled to the pin 42. The channel 44 extends around a complete diameter of the wheel 46 wherein tension in the loop 30 as the tube 12 is compressed is distributed evenly over each roller 36. A swivel bracket 48 may be coupled to the bottom section 14 of the tube 12. The first end 32 of the loop 30 is coupled to the swivel bracket 48.

An elongated extension 50 may define the second portion 20 of the top section 16. The extension 50 has a first end 52 selectively couplable to an upper end 54 of the first portion 18 of the top section 16 of the tube 12. A handle 56 is selectively couplable to the extension 50 wherein the handle 56 is in a static position relative to the upper section 16 of the tube 12. Thus, the handle 56 is configured to be grasped to facilitate urging the upper section 16 of the tube 12 to slide into the bottom section 14 of the tube 12. The handle 56 may have a pair of outer sections 58. The outer sections 58 extend outwardly from the extension 50 when the handle 56 is coupled to the extension 50. The outer sections 58 may extend transversely relative to the extension 50. Each outer section 58 may further comprise a first section 60 and a second section 62 with the first section 60 forming a right angle with the second section 62.

A sleeve 64 may be coupled to the handle 56. The extension 50 is inserted through the sleeve 64. The handle 56 may comprise an offset section 66 coupled to and extending between the sleeve 64 and the outer sections 58 of the handle 56 wherein the outer sections 58 are laterally offset from the extension 50. A locking member 68 selectively engages the sleeve 64 and the extension 50 wherein the locking member 68 secures the sleeve 64 in a static position on the extension 50. A plurality of holes 70 extends through the extension 50. The locking member 68 is engageable to a selectable one of the holes 70 wherein the handle 56 is selectively positionable along a length of the extension 50. A plurality of apertures 72 extends through the first portion 18 of the top section 16 of the tube 12. Each aperture 72 is aligned with the slot 24. The pin 42 is couplable to a selectable one of the apertures 72 wherein resistance to compression from the loop 30 is adjustable by selective positioning of the pin 42 along a length of the top section 16 of the tube 12 within the slot 24.

In use, the device 10 is configured to provide a desired amount of resistance as the tube 12 is compressed. The handle 56 may be used or the top section 16 of the tube 12 may be grasped directly and force exerted to compress the top section 16 into the bottom section 14. The loop 30 provides resistance over the full range of motion during compression. The user may also release compressive force on the tube 12 gradually to prevent the loop 30 from aggressively expanding the tube 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A compressive exercise device comprising:

a tube being elongated and having a bottom section and a top section, said top section being slidably inserted into said bottom section wherein said tube is telescopic;

a longitudinal slot extending through said bottom section of said tube, said slot having a top end and a bottom end;

a loop, said loop being resilient, said loop having a first end coupled to said bottom section of said tube proximate a bottom end of said bottom section of said tube;

a pair of rollers, each said roller being coupled to an associated side of said bottom section of said tube between said top end of said slot and a top end of said bottom section of said tube, said loop extending over each of said rollers; and a pin coupled to said top section of said tube, said pin extending through said slot and being slidable in said slot as said top section of said tube slides relative to said bottom section of said tube, said loop being coupled to said pin such that said loop is stretched as said pin is moved in said slot away from said top end of said slot towards a bottom end of said slot wherein said loop provides resistance to compression of said tube.

2. The device of claim 1, further comprising a channel coupled to said pin, said loop being seated in said channel.

3. The device of claim 2, further comprising a wheel rotatably coupled to said pin, said channel extending around a complete diameter of said wheel wherein tension in said loop as said tube is compressed is distributed evenly over each said roller.

4. The device of claim 1, further comprising a swivel bracket coupled to said bottom section of said tube, said first end of said loop being coupled to said swivel bracket.

5. The device of claim 1, further comprising an elongated extension, said extension having a first end selectively couplable to an upper end of said upper section of said tube.

6. The device of claim 5, further comprising a handle, said handle being selectively couplable to extension wherein said handle is in a static position relative to said upper section of said tube wherein said handle is configured to be grasped to facilitate urging said upper section of said tube to slide into said bottom section of said tube.

7. The device of claim 6, further comprising:

a sleeve coupled to said handle, said extension being inserted through said sleeve; and a locking member, said locking member selectively engaging said sleeve and said extension wherein said locking member secures said sleeve in a static position on said extension.

8. The device of claim 7, further comprising a plurality of holes extending through said extension, said locking member being engageable to a selectable one of said holes wherein said handle is selectively positionable along a length of said extension.

9. The device of claim 7, further comprising said handle having a pair of outer sections, said outer sections extending outwardly from said extension when said handle is coupled to said extension.

10. The device of claim 9, further comprising said outer sections extending transversely relative to said extension.

11. The device of claim 9, further comprising said handle comprising an offset section coupled to and extending between said sleeve and said outer sections of said handle wherein said outer sections are laterally offset from said extension.

12. The device of claim 9, further comprising each said outer section comprising a first section and a second section, said first section forming a right angle with said second section.

13. The device of claim 1, further comprising a plurality of apertures extending through said top section of said tube, each said aperture being aligned with said slot, said pin being couplable to a selectable one of said apertures wherein resistance to compression from said loop is adjustable by selective positioning of said pin along a length of said top section of said tube within said slot.

14. The device of claim 1, further comprising:

said top section of said tube comprising a first portion coupled to a second portion; and a connector coupling said first portion to said second portion such that said first portion is linearly aligned with said second portion.

15. A compressive exercise device comprising:

a tube being elongated and having a bottom section and a top section, said top section being slidably inserted into said bottom section wherein said tube is telescopic, said top section of said tube comprising a first portion coupled to a second portion, a connector coupling said first portion to said second portion such that said first portion is linearly aligned with said second portion;

a longitudinal slot extending through said bottom section of said tube, said slot having a top end and a bottom end;

a loop, said loop being resilient, said loop having a first end coupled to said bottom section of said tube proximate a bottom end of said bottom section of said tube;

a pair of rollers, each said roller being coupled to an associated side of said bottom section of said tube between said top end of said slot and a top end of said bottom section of said tube, said loop extending over each of said rollers;

a pin coupled to said top section of said tube, said pin extending through said slot and being slidable in said slot as said top section of said tube slides relative to said bottom section of said tube, said loop being coupled to said pin such that said loop is stretched as said pin is moved in said slot away from said top end of said slot towards a bottom end of said slot wherein said loop provides resistance to compression of said tube;

a channel coupled to said pin, said loop being seated in said channel;

a wheel rotatably coupled to said pin, said channel extending around a complete diameter of said wheel wherein tension in said loop as said tube is compressed is distributed evenly over each said roller;

a swivel bracket coupled to said bottom section of said tube, said first end of said loop being coupled to said swivel bracket;

an elongated extension, said extension having a first end selectively couplable to an upper end of said upper section of said tube;

a handle, said handle being selectively couplable to extension wherein said handle is in a static position relative to said upper section of said tube wherein said handle is configured to be grasped to facilitate urging said upper section of said tube to slide into said bottom section of said tube, said handle having a pair of outer sections, said outer sections extending outwardly from said extension when said handle is coupled to said extension, said outer sections extending transversely relative to said extension, each said outer section comprising a first section and a second section, said first section forming a right angle with said second section;

a sleeve coupled to said handle, said extension being inserted through said sleeve, said handle comprising an offset section coupled to and extending between said sleeve and said outer sections of said handle wherein said outer sections are laterally offset from said extension;

a locking member, said locking member selectively engaging said sleeve and said extension wherein said locking member secures said sleeve in a static position on said extension;

a plurality of holes extending through said extension, said locking member being engageable to a selectable one of said holes wherein said handle is selectively positionable along a length of said extension; and a plurality of apertures extending through said top section of said tube, each said aperture being aligned with said slot, said pin being couplable to a selectable one of said apertures wherein resistance to compression from said loop is adjustable by selective positioning of said pin along a length of said top section of said tube within said slot.

* * * * *